US008051673B2

(12) United States Patent
Spiller

(10) Patent No.: US 8,051,673 B2
(45) Date of Patent: Nov. 8, 2011

(54) CIRCULATING AIR REFRIGERATING APPLIANCE AND ASSEMBLY METHOD THEREFOR

(75) Inventor: Ralf Spiller, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 592 days.

(21) Appl. No.: 12/085,647

(22) PCT Filed: Oct. 24, 2006

(86) PCT No.: PCT/EP2006/067704
§ 371 (c)(1),
(2), (4) Date: May 27, 2008

(87) PCT Pub. No.: WO2007/062934
PCT Pub. Date: Jun. 7, 2007

(65) Prior Publication Data

US 2010/0031684 A1 Feb. 11, 2010

(30) Foreign Application Priority Data

Nov. 30, 2005 (DE) ..... 10 2005 057 157

(51) Int. Cl.
*F24F 45/00* (2006.01)

(52) U.S. Cl. ..... 62/414

(58) Field of Classification Search ..... 62/414, 62/259.1, 298, 515, 77, 314, 419, 455; 29/700, 29/408
See application file for complete search history.

(56) References Cited

U.S. PATENT DOCUMENTS

| | | | | |
|---|---|---|---|---|
| 4,457,140 | A * | 7/1984 | Rastelli | 62/261 |
| 4,742,691 | A * | 5/1988 | Kennedy | 62/272 |
| 4,977,750 | A * | 12/1990 | Metcalfe | 62/77 |
| 5,112,024 | A * | 5/1992 | Stanko | 248/603 |
| 6,089,146 | A * | 7/2000 | Nam et al. | 99/468 |
| 7,032,406 | B2 * | 4/2006 | Hollen et al. | 62/347 |
| 2004/0172927 | A1 * | 9/2004 | Lee | 55/495 |
| 2006/0026985 | A1 * | 2/2006 | Hollen et al. | 62/340 |

FOREIGN PATENT DOCUMENTS

| | | |
|---|---|---|
| DE | 198 59 985 | 6/2000 |
| GB | 1021496 | 3/1966 |
| WO | WO 2005/100889 | 10/2005 |

OTHER PUBLICATIONS

International Search Report PCT/EP2006/067704.

* cited by examiner

*Primary Examiner* — Mohammad Ali
(74) *Attorney, Agent, or Firm* — James E. Howard; Andre Pallapies

(57) ABSTRACT

A circulating air refrigerating appliance surrounds at least one storage region and an evaporation chamber containing an evaporator. The evaporator engages with projections extending from an inner wall of the housing defining the evaporation chamber. A separating wall between the storage region and the evaporation chamber is mounted adjacently to the evaporator in the housing.

9 Claims, 1 Drawing Sheet

CIRCULATING AIR REFRIGERATING APPLIANCE AND ASSEMBLY METHOD THEREFOR

BRIEF SUMMARY OF THE INVENTION

The present invention relates to a circulating air refrigeration appliance, also referred to as a no-frost refrigeration appliance, and to a method for the assembly thereof. In a refrigeration appliance of said kind an evaporator is typically housed in a chamber which is separated from a storage area in the interior of the appliance housing by a partition wall. Usually the evaporator of such a refrigeration appliance is preassembled outside of the housing together with other parts such as e.g. the already mentioned partition wall, heat-conducting plates, air guide plates or the like, into an assembly which is subsequently inserted as a whole into the refrigeration appliance housing, these other components which, in the assembled state, conceal the evaporator, being fixed to the housing. Manufacturing tolerances of the appliance housing, of the parts of the assembly fixed to the appliance housing, and of the evaporator and its placement in the assembly itself lead to a considerable variation in the installation position of the evaporator. This variation is reflected in values that vary from appliance to appliance in respect of the flow resistance of the evaporator chamber, the performance of the evaporator etc. In the extreme case the operational reliability of the appliance can be compromised by an unfavorable positioning of the evaporator.

The object of the invention is to create a circulating air refrigeration appliance and an assembly method therefor which permit variations of said kind to be reduced.

The object is achieved in that in the case of a circulating air refrigeration appliance having a housing which encloses at least one storage area and an evaporator chamber in which an evaporator is housed, projections stick out on an inner wall of the housing bordering the evaporator chamber and the evaporator is locked in place on said projections in a snap-fit manner. Directly fixing the evaporator to the projections reduces the variation in the evaporator position; furthermore, since the snap-fitted evaporator is not hidden behind other parts at the time of its installation, a visual check on its placement and, if necessary, a correction are possible.

A pincer which grips around a tube of the evaporator is preferably formed at the tip of each of the projections.

An insertion opening for the tube on the pincer preferably faces away from the inner wall supporting the projection so that the evaporator can be snapped in place in the pincer in a movement directed toward the inner wall. In an engaging movement of this kind the projections are essentially subjected only to a compressive load, while torsional moments which could subject the connection of the projections with the inner wall supporting them to excessive loads, are avoided.

A stem of the projection is preferably formed by at least two struts extending from the pincer to the inner wall and spaced apart from one another by a gap. This design permits the projections to be implemented as lightweight elements with a small cross-sectional area and yet still be robust, even against torsional moments acting upon them. Moreover, the subdivision into a plurality of struts enables the projections to be warmed up quickly when the evaporator is defrosted, with the result that the projections too are reliably freed of ice during defrosting, even if they are made from a less efficiently heat-conducting material than the evaporator, in particular from a plastic.

The projections are preferably molded parts, each of which is anchored in an opening in the inner wall. This permits the inner wall to be molded by deep-drawing in a highly competent manner that is known per se.

For the purpose of fixing the molded parts in the inner wall, the molded parts preferably each have a head section which engages in the opening in the inner wall and is undercut at two edges so as to grip the edge of the opening at the back at two points, and which has a gap between the two edges. The gap makes it easier for the two edges to move toward each other elastically when the head section is installed in the opening, either when the head section is press-fitted into the opening or when the head section, having already been introduced into the opening, is rotated.

The invention can be applied particularly advantageously in the case of a finned-tube evaporator, though it is generally suitable for any type of evaporator which has tubes that can be gripped around by a pincer.

A dividing wall between storage area and evaporator chamber is preferably installed in the housing independently of the evaporator. This allows the evaporator chamber to be exposed for the purpose of rectifying a fault by removing the dividing wall, while at the same time the evaporator is left in situ.

The object is also achieved by means of a method for assembling a circulating air refrigeration appliance, in particular an appliance as described above, wherein an evaporator is first locked in place in a snap-fit manner on projections sticking out from an inner wall of a housing of the appliance and then a dividing wall is installed at the inner wall, subdividing the interior of the housing into a storage area and an evaporator chamber. The projections are preferably created by anchoring molded parts in an opening in the inner wall.

BRIEF DESCRIPTION OF THE DRAWINGS

Further features and advantages of the invention will emerge from the following description of exemplary embodiments with reference to the attached figures, in which.

DETAILED DESCRIPTION OF THE PRESENT INVENTION

Figure 1:
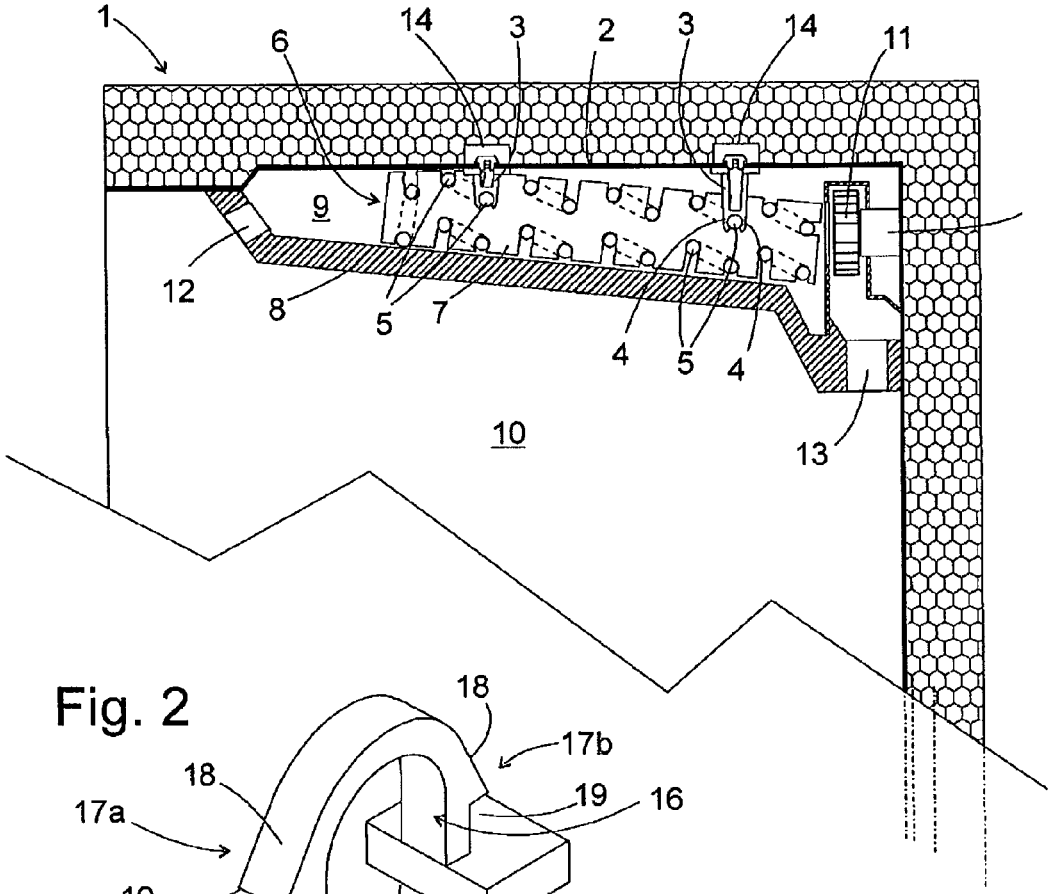
FIG. 1 shows a schematic vertical section through the upper region of the carcass of a refrigeration appliance according to the invention.

FIG. 1 shows a schematic section through the upper region of the carcass 1 of a refrigeration appliance. The carcass 1 has in a manner known per se a solid outer skin made of sheet metal which is tightly joined at a front side of the carcass to a container which is deep-drawn from plastic and forms an inner wall 2 of the carcass. The space between outer skin and inner wall 2 is essentially filled with insulating foam material.

Cut into the ceiling of the inner wall 2 are a plurality of openings which are covered on the insulating foam side by a tightly fitted cap 14. Locked in place in a snap-fit manner in said openings are carrier parts 3, two of which can be seen in the figure. The carrier parts 3 are molded from a solid plastic such as e.g. POM and at their end facing away from the inner wall 2 form in each case a pincer with two clamping jaws 4 which are sufficiently elastically deformable to be clipped onto a tube 5 of a finned-tube evaporator 6. The evaporator has a plurality of parallel fins 7, of which one can be seen in the figure. The fins 7 are metal plates of essentially rectangular outline with a plurality of cutouts open at the edge through which the tube 5 runs in serpentine fashion.

The carrier parts 3 anchor the evaporator 6 firmly to the ceiling of the inner container; it therefore requires no further support by means of a dividing wall 8 that is installed thereunder and separates a chamber 9 accommodating the evaporator from a storage area 10 for refrigerated items that is located thereunder.

Also housed in the evaporator chamber 9 is a fan 11 which sucks in air through the evaporator 6 from an inlet port 12 of the evaporator chamber 9 and expels it back into the storage area 10 via an outlet port 13 adjacent to the rear wall of the carcass 1.

Figure 2:
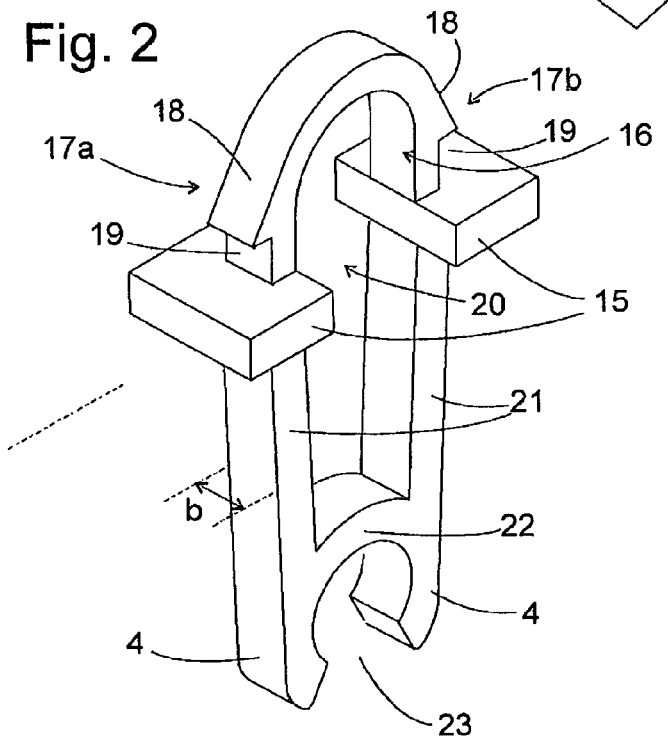
FIG. 2 shows a perspective view of a carrier part used to secure the evaporator in the refrigeration appliance of FIG. 1.

FIG. 2 shows a perspective view of one of the carrier parts 3. The carrier part 3 is injection-molded as a single piece from plastic and has a two-part baseplate 15 which in the installed state sits against the underside of the ceiling of the container forming the inner wall. A head section 16 serving to anchor the carrier part to the ceiling has inclined surfaces 18 in each case converging upward toward each other on two opposing edges 17*a*, 17*b*, and at the foot of the inclined surfaces 18 has in each case an undercut 19 whose height corresponds to the thickness of the inner container. A gap 20 which separates the two parts of the baseplate 15 from each other extends into the head section 16 and makes it easier for the edges 17 to move toward each other when the head section 16 is press-fitted into an opening in the inner container, and to move apart from each other again elastically as soon as the inclined surfaces 18 have passed the opening, such that in the assembled state the inner container locks into place in a snap-fit manner in the undercuts 19.

Two struts 21 extending downward from the parts of the baseplate 15 carry a circular-arc-shaped pincer 22, wherein the ends of the circular arc form the clamping jaws 4. The pincer has a downward-directed opening 23 into which the tube 5 of the evaporator 6 (not shown in FIG. 2) introduced from below can be press-fitted. The temporary deformation of the pincer 22 during the press-fitting leads to a flexural loading of the struts 21 which can result in the two parts of the baseplate 15 temporarily moving toward each other. However, since the baseplate 15 is pressed against the inner container at the same time, this does not adversely affect the anchorage of the carrier part 3 on the inner container. The two struts 21 separated by the gap 20 give the carrier part 3 great stability, thus protecting it against being bent back or snapped off while at the same time being economical in terms of use of material. The cross-sectional area of the struts 21 can be kept significantly smaller than that of a comparably loadable single strut. This not only saves material and costs, but also enables the carrier part 3 to warm up quickly when the evaporator is being defrosted, with the result that the carrier part 3, in spite of the poor conductivity of its plastic material compared to the metal of the evaporator 6, is also reliably defrosted.

As can be seen already in FIG. 1, various types of carrier parts 3 differing in the length of their struts 21 can be used. At approx. 5 mm, the width b of the struts 21 and the pincer 22 is significantly less than the spacing of the parallel fins 7 of the evaporator 6 from one another so that the pincer 22 can be introduced between the fins 7 without difficulty and with a certain allowance for clearance in the lateral direction.

The head section 16 can be installed not only by press-fitting into an opening in the inner wall 2, but also in the manner of a bayonet mechanism, wherein it is introduced into an elongated opening of the inner container, initially without being deformed, until the baseplate 15 touches the inner container, and is then rotated through 90° so that the longitudinal edges of the elongated hole engage in the undercuts 19.

The invention claimed is:

1. A circulating air refrigeration appliance having a housing enclosing at least one storage area and an evaporator chamber housing an evaporator, the refrigeration appliance comprising projections extending from an inner wall of the housing bordering the evaporator chamber wherein the evaporator is locked in place in a snap-fit manner on said projections, and further comprising a pincer formed at the tip of the projections configured for gripping around a tube of the evaporator.

2. The circulating air refrigeration appliance according to claim 1 wherein the pincer is formed with an insertion opening facing away from the inner wall and configured for introduction of the tube.

3. The circulating air refrigeration appliance according to claim 1 wherein a stem of the projection is formed by at least two struts extending from the pincer to the inner wall and spaced apart from one another by a gap.

4. The circulating air refrigeration appliance according to claim 1 wherein the projections are formed as molded parts, with each molded part being anchored in a respective opening in the inner wall.

5. The circulating air refrigeration appliance according to claim 4 wherein the molded parts are each formed with a head section configured for engagement with the opening in the inner wall, wherein the head section is undercut at two edges and being formed with a gap between the two edges.

6. The circulating air refrigeration appliance according to claim 1 wherein the evaporator is a finned-tube evaporator.

7. The circulating air refrigeration appliance according to claim 1 and further comprising a dividing wall disposed between the storage area and the evaporator chamber and installed in the housing independently of the evaporator.

8. The circulating air refrigeration appliance according to claim 4, wherein each opening in the inner wall is capped.

9. A method for assembling a circulating air refrigeration appliance comprising the steps of locking an evaporator in place in a snap-fit manner on projections extending from an inner wall of a housing of the appliance; installing a dividing wall at the inner wall thereby subdividing the interior of the housing into a storage area and an evaporator chamber, and anchoring molded parts in openings in the inner wall thereby forming projections, wherein the openings in the inner wall are capped.

* * * * *